US005415060A

United States Patent [19]

DeStefano, Jr.

[11] Patent Number: 5,415,060

[45] Date of Patent: May 16, 1995

[54] INCREMENTAL ADVANCE MEANS

[76] Inventor: Albert M. DeStefano, Jr., 75 First Ave. & Tillman St., Raritan, N.J. 08869

[21] Appl. No.: 160,417

[22] Filed: Dec. 1, 1993

Related U.S. Application Data

[62] Division of Ser. No. 940,508, Sep. 4, 1992, Pat. No. 5,290,521.

[51] Int. Cl.[6] ..... G05G 5/06

[52] U.S. Cl. ..... 74/540; 74/529; 74/536

[58] Field of Search ..... 74/527, 529, 528, 535, 74/536, 540, 541, 503

[56] References Cited

U.S. PATENT DOCUMENTS

| | | | |
|---|---|---|---|
| 312,001 | 2/1885 | Meyers | 74/540 |
| 353,223 | 11/1886 | Hughes | 74/540 |
| 2,703,990 | 3/1955 | Stricklin | 74/503 |
| 3,168,124 | 2/1965 | Lenkey . | |
| 3,520,660 | 7/1970 | Webb et al. . | |
| 3,687,175 | 8/1972 | Babey et al. . | |
| 4,174,550 | 11/1979 | Hurst | 74/541 X |
| 4,276,048 | 6/1981 | Leaback . | |
| 4,390,115 | 6/1983 | Bigham | 74/540 X |
| 4,463,625 | 8/1984 | Nishikawa | 74/540 X |
| 4,478,094 | 10/1984 | Salomaa et al. . | |
| 4,890,930 | 1/1990 | Nohso . | |
| 4,919,894 | 4/1990 | Daniel . | |
| 4,988,618 | 1/1991 | Li et al. . | |
| 5,055,263 | 10/1991 | Meltzer . | |
| 5,055,271 | 8/1991 | Golias et al. . | |

FOREIGN PATENT DOCUMENTS

| | | | |
|---|---|---|---|
| 1177013 | 8/1964 | Germany | 74/540 |
| 54-25027 | 2/1979 | Japan | 74/540 |
| 54-55926 | 5/1979 | Japan | 74/540 |
| 54-57726 | 5/1979 | Japan | 74/540 |
| 55-44015 | 3/1980 | Japan | 74/540 |
| 405516 | 2/1934 | United Kingdom | 74/540 |

*Primary Examiner*—Vinh T. Luong
*Attorney, Agent, or Firm*—William C. Long

[57] ABSTRACT

There is provided a lab-top work station which is designed for use in the manual application of liquid to a slide or microwell plate and consists of a slide holder, a bridge for support of manual liquid dispensers at a predetermined location with respect to the slide holder, and a manual incremental advance mechanism for manually moving the slide holder a predetermined distance.

1 Claim, 9 Drawing Sheets

INCREMENTAL ADVANCE MEANS

This is a divisional of Ser. No. 07/940,508, filed on Sep. 4, 1992, now U.S. Pat. No. 5,290,521.

BACKGROUND OF THE INVENTION

1. Field of the Invention

The present invention relates to incremental ratchet advance means especially adapted for use in an inexpensive, portable work station for manually applying a liquid solution from a hand-held liquid dispenser, such as a multiple pipette dispenser, with greatly improved accuracy to a multi-well slide or plate.

2. Background of the Invention

In many fields and most notably in the medical field, the application of liquid solution from one or more liquid applicators to a plate or slide in an accurate and convenient fashion is of great importance.

There exists, for example, fully automated devices for dispensing liquid solution from a plurality of dispensers such as pipettes, in controlled-amounts to specific locations on a plate or slide. A problem with such devices has been that they are extremely costly, frequently far beyond the means of smaller laboratories.

U.S. Pat. Nos. 4,478,094 and 5,055,263 relate to automated liquid transfer procedures. The devices described are not adapted for portable, manual operations as is the device of the present invention.

U.S. Pat. No. 4,988,618 relates to magnetic separation devices for use in immunoassay or hybridization assay procedures. The reference does not describe the portable, manually operated device of the present invention.

U.S Pat. No. 4,919,894 provides an apparatus for pipetting material in individual microwells on a microteter plate. The reference does not describe the apparatus of the present invention which is believed to be easier to use and more accurate.

U.S. Pat. No. 4,276,048 provides an automated device fors conducting a multiplicity of chemical reactions with micro-volumes of liquids. The reference does not show the manually operated portable apparatus of the invention.

U.S. Pat. No. 3,168,124 describes a fluid sampling apparatus which acquires a fluid sample and dispenses the sample into a container such as a test tube. The reference does not show the apparatus of the present invention.

There are many applications, especially in the medical testing area, where laboratory workers must apply a liquid solution with a hand-held liquid dispenser to a multi-well slide or plate in a convenient and accurate manner. In such applications it is important that the slide or plate be held in a steady and precise alignment, that the hand-held liquid dispenser be held steady in alignment with the slide or plate and that the liquid be dispersed accurately onto the slide or plate.

The present invention provides incremental ratchet advance means useful in a portable device which is specifically designed to assist a lab worker in the use of a hand-held liquid dispenser in the convenient and accurate application of a liquid solution onto a slide or microwell plate.

BRIEF DESCRIPTION OF THE INVENTION

The incremental ratchet advance means of this invention is especially useful with a work station which comprises a flat base, a slide or microwell plate holder which is positioned between two parallel side rails attached to the base and which is adapted to be moved a predetermined distance by the operation of the incremental ratchet advance means. Positioned over the slide or microwell plate holder is a bridge which is adapted to align and hold steady hand-held liquid dispenser means such as multiple pipettes for convenient and accurate manual application of liquid to specific locations on the slide or plate.

The same numbering of the elements of the work station of this invention is used in all of the attached drawings.

DETAILED DESCRIPTION

Figure 1:
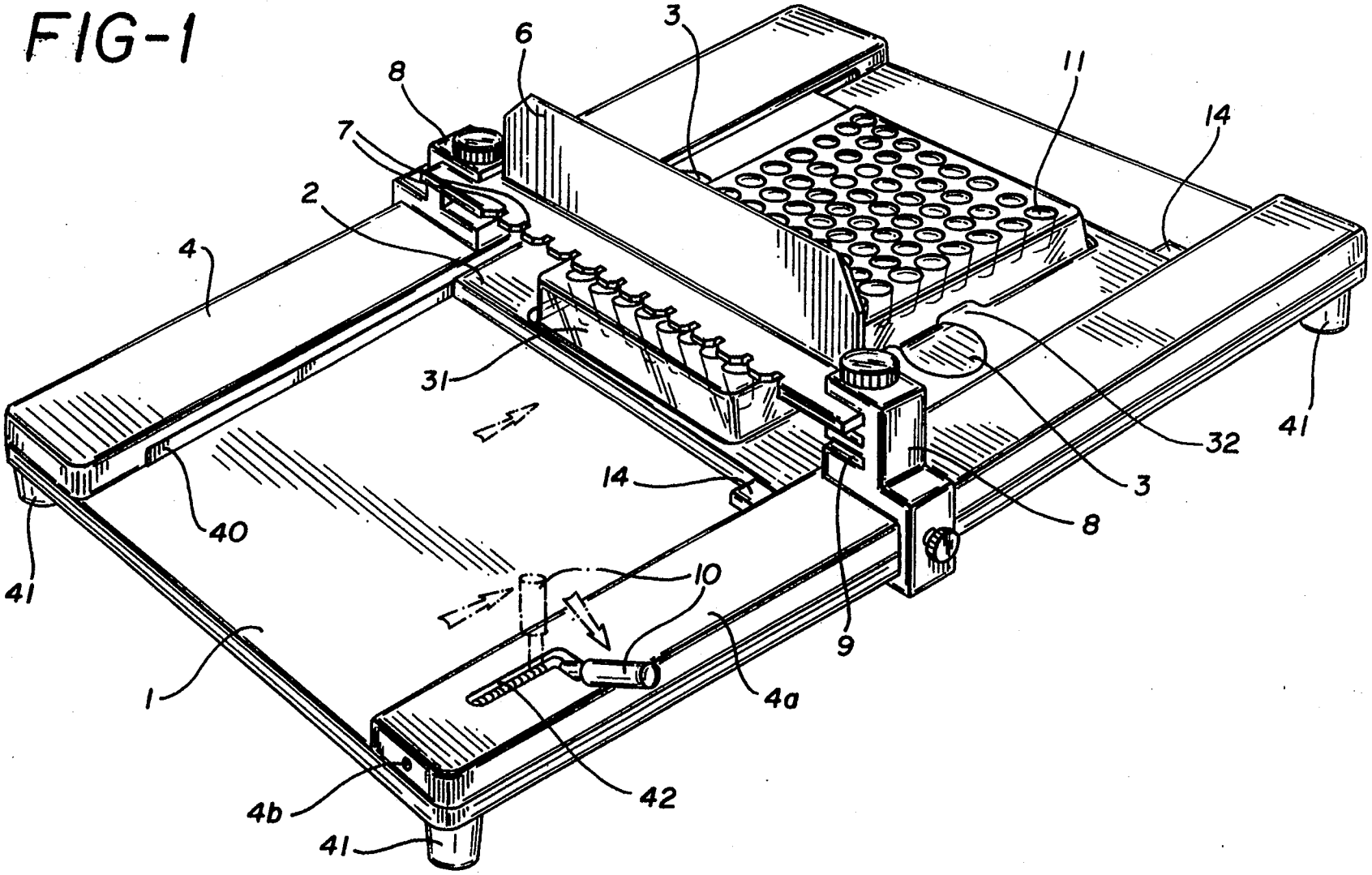
FIGS. 1 and 1*a* illustrate a suitable apparatus in accordance with the invention with the slide or plate holder in different postilions.
Figure 1A:
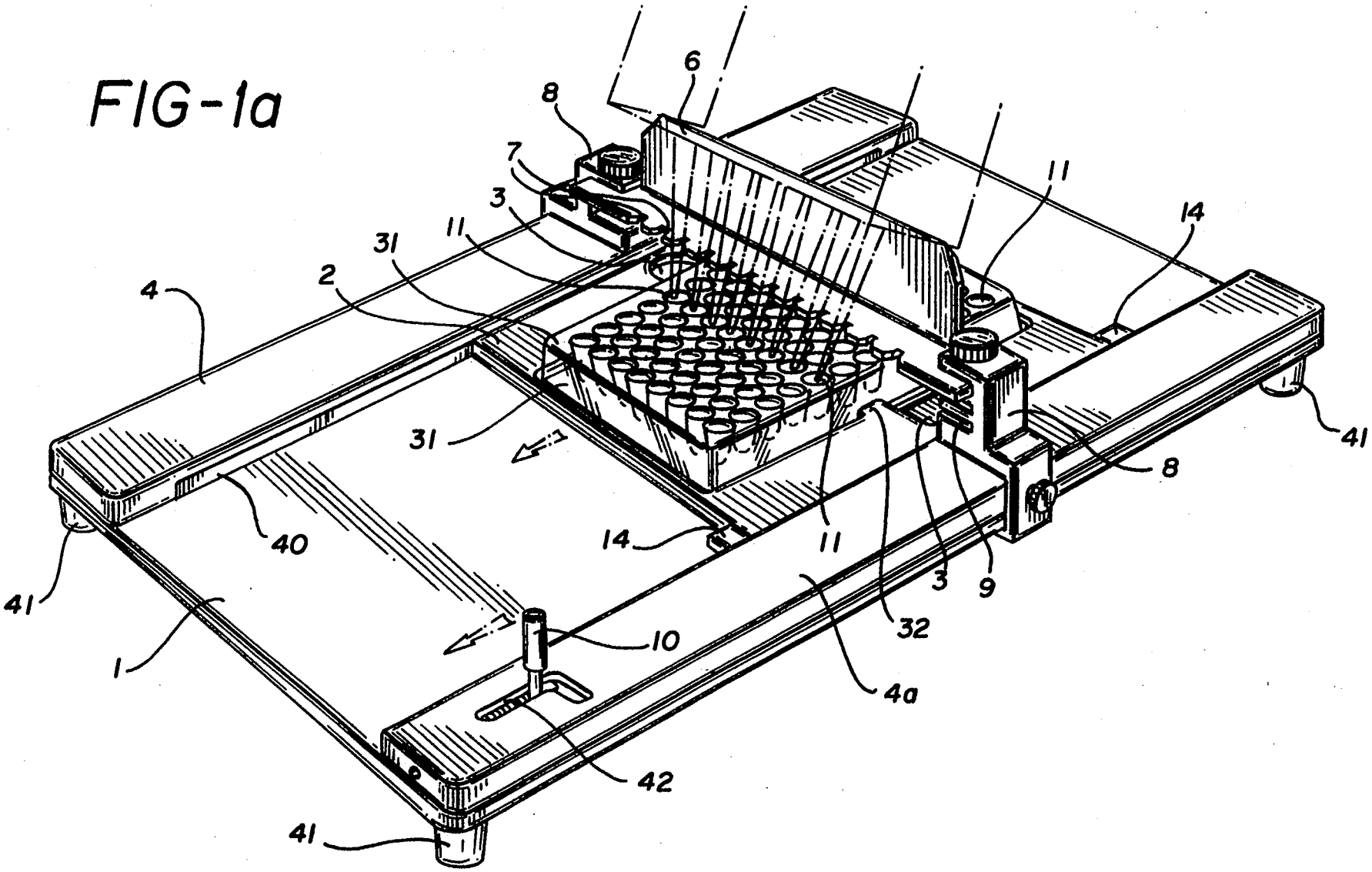
Figure 2:
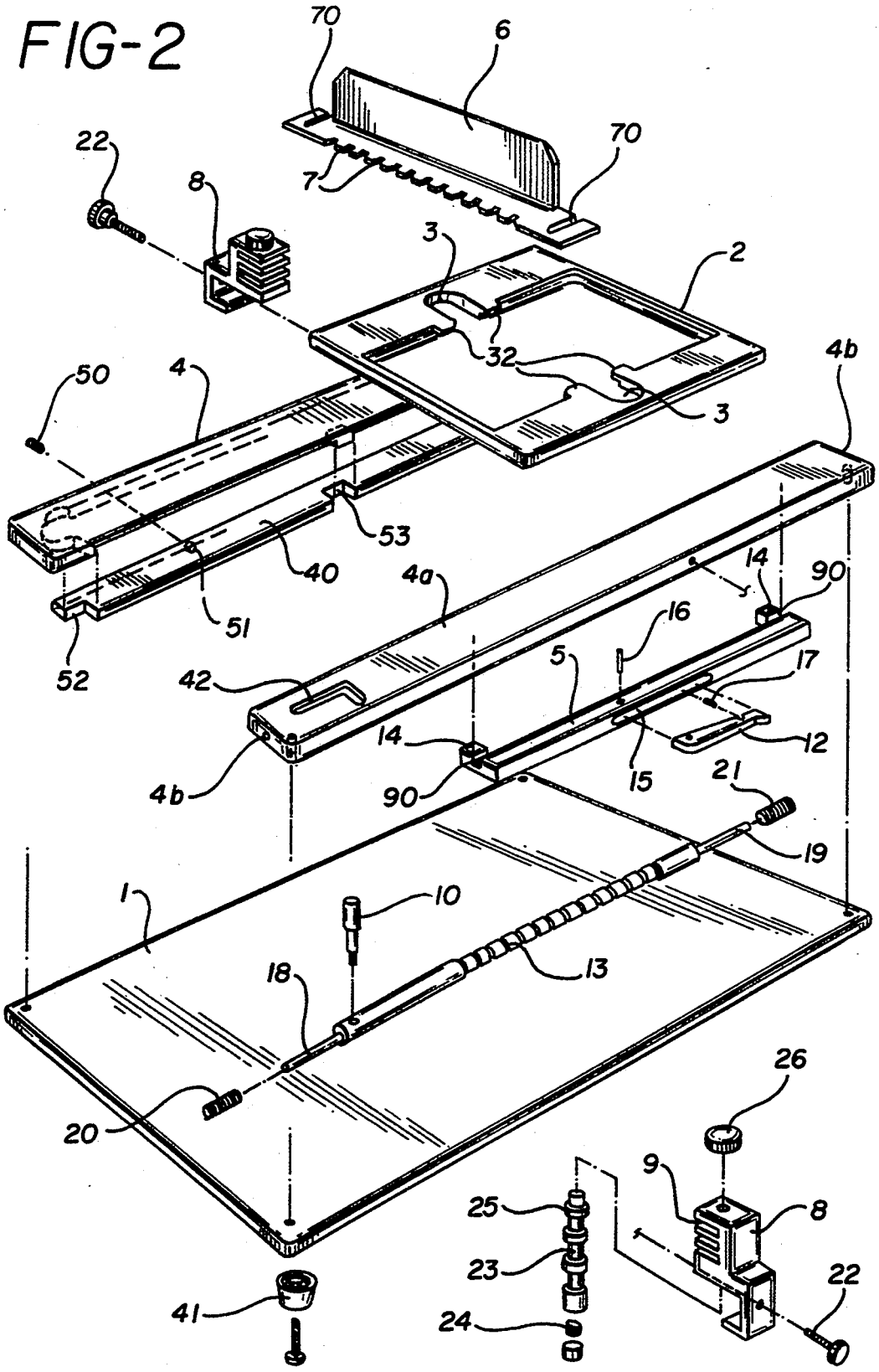
FIG. 2 illustrates an exploded view of portions of the apparatus of FIGS. 1 and 1*a*.

A lab-top work station configuration in accordance with the present invention is illustrated in FIGS. 1, 1*a* and 2 in which the overall work station is shown in FIGS. 1 and 1*a* and an exploded view of various elements of the work station is shown in FIG. 2. Referring to FIGS. 1, 1*a* and 2, a lab-top flat base 1 is provided on which there is positioned a slide or plate holder 2 which is adapted to securely hold an appropriate glass slide or microwell plate in place. In a preferred embodiment, holder 2 is provided with at least two recessed indentations 3 which extend at least to the edge of the slide or plate and preferably extend slightly past the edge and which enable the slides or plates to be easily placed by hand in the holder and manually lifted therefrom.

The slide or plate holder 2 is positioned on base 1 between parallel guide rails 4 and 4*a* and between projections 14 of intermittent ratchet advance means 5.

Mounted over lab-top base 1 is bridge 6 which is adapted to support a plurality of manual liquid dispensing means such as pipettes in stable position for the manual application of solution quickly and accurately to designated locations 11 on a slide or plate. In an especially preferred embodiment as shown, for example, in FIG. 2, bridge 6 is provided with a plurality of grooved slots 7 which are adapted to hold the liquid dispensing means in place as shown in phantom in FIG. 1*a*.

The bridge 6 is held in place by two adjustable bridge support mounting means 8. Appropriately, adjustable bridge support mounting means 8 are provided with slots 9 for receiving the bridge and holding the bridge securely in a fixed position over the lab-top base. In especially preferred practice, each adjustable bridge support mounting means 8 has a plurality of slots 9 at different levels such that bridge 6 can be mounted at different convenient heights above base 1 for ease and accuracy of applying liquid to a slide or plate from manually-held liquid dispensing means. This feature can be seen in the drawings, especially FIGS. 1, 1*a*, 2 and 4.

Side rail 4a is recessed on its underside and incorporates in the recessed portion means for advancing slide or plate holder 2 a predetermined distance by manual operation of lever 10. This is shown, for example, in FIGS. 3, 3a and 3b.

In operation as shown, for example, in FIGS. 1 and 1a, a slide or plate 31, to which liquid is to be applied, is placed in the rectangular recess in holder 2. The slide or microwell plate 31 is of the type conventionally used and most commonly has 96 separate wells in 8 by 12 rows. Microwell plates, for example those sold by the Cole-Parmer Instrument Company, generally have greater depth than do glass slides, and the rectangular recess of slide or plate holder 2 is sized to securely hold the slide or plate in the desired position. It is usually advantageous to have a plurality of holders 2 sized respectively to securely hold slides and plates; the holders for plates generally have a deeper rectangular recessed portion to receive the plates as well as a slight lip 32 to hold the plates in place as shown in FIGS. 1, 1a, 2, 3, 3a and 3b. In the case of application of liquid to slides, holder 2 need not have lips 32; this is not illustrated.

The design of holder 2 is of special importance in accordance with the invention. As shown, for example, in exploded FIG. 2, holder 2 is square in shape with a rectangular recess having sides parallel to the sides of holder 2 which is sized to receive and hold securely in place a slide or plate. In FIGS. 1 and 1a there is depicted a conventional microwell plate 31 positioned in holder 2.

Since holder 2 is square in shape, holder 2 can be inserted between projections 14 of holder 5 such that the slide or plate well rows having the desired number of well locations are parallel to bridge 6. In FIG. 1 and 1a, holder 2 is positioned such that microwell plate rows having 8 wells are parallel to bridge 6 for liquid application with a dispenser having 8 pipette tips. Where a 12 pipette dispenser is to be used, holder 2 is rotated 90 degrees before insertion and is inserted in holder 5 such that the slide or microwell plate 31 rows having 12 wells are parallel to bridge 6.

A further feature of holder 2 is that it is designed such that the slide or plate wells are properly aligned to receive liquid from the manual dispenser whether the 8 or alternately 12 well rows are parallel to bridge 6. This can be accomplished by locating the center of the rectangular recess within square holder 2 at the center of holder 2. When square holder 2 is removed and rotated 90 degrees and placed on base 1 between projections 14, liquid can be applied to either an 8-well row or alternately a 12-well row with the appropriate pipettor and pipette tips with the same point of reference when incremented.

In operation, lever 10 is manually depressed in L-shaped slot 42 of side rail 4a as shown in FIG. 1 permitting the holder 2 to be moved by hand from a holding position at the left of base 1 to a starting position at the far right of base 1 as shown in FIG. 1. Lever 10 is then moved to an upright position in slot 42 as shown in FIG. 1a thus engaging intermittent advance means 5 for moving holder 2 a predetermined distance when upright lever 10 is moved. Subsequently, lever 10 is moved to the left to advance the holder 2 the predetermined distance, usually corresponding to the distance between centers of wells on the slide or plate 31. When the slide or plate 31 has been advanced to position for application of liquid, a hand-held multiple pipettor liquid dispenser is positioned resting against bridge 6 with the dispenser tips aligned with the wells of a particular row on slide or plate 31 as illustrated, and liquid is manually dispensed thereon. A suitable dispenser is partially illustrated in phantom in FIG. 1a.

Lever 10 is then manually moved to the left usually by the thumb and forefinger of the operator to advance holder 2 with the slide or plate 31 positioned thereon to bring the next row of wells to the appropriate position for application of liquid thereto. This procedure is repeated until all of the wells on the slide or as many as desired have had liquid applied thereto. In the view illustrated in FIG. 1a, the liquid dispenser is shown dispensing liquid to the fifth row of wells.

Lever 10 in the upright position in slot 42 is positioned such that its travel to the left is a distance which is the same as that between centers of wells on the plate or slide 31, usually 9 mm.

When the application of liquid to a particular slide or plate 31 is complete, the slide or plate 31 is removed from the holder 2 and a fresh slide or plate 31 can be inserted for subsequent liquid application procedures. Holder 2 can easily be removed and sterilized between liquid applications.

Conveniently, the base 1 is provided with feet 41, usually made of rubber, for ease of use on a laboratory table surface, and it is advantageous to assemble the apparatus by screws passing through the feet 41 and base 1 and securing the screws to guide rails 4 and 4a as illustrated in FIGS. 1, 1a and 2, for example.

FIG. 2 is an exploded view of various components of the apparatus of the invention shown in FIGS. 1 and 1a, and illustrates in more detail certain of these components. Specifically, as previously indicated, retaining rail 4a is recessed in its underside, and positioned in the recess is intermittent ratchet advance 5. As depicted in FIGS. 2, 3, 3a and 3b, for example, intermittent ratchet advance 5 is a U-shaped component lengthwise, and only the end projections 14 extend outwardly from under rail 4a. The distance between projections 14 is sized to closely fit the dimensions of holder 2 in order that square holder 2 may be maintained securely between these projections on base 1.

Figure 3:
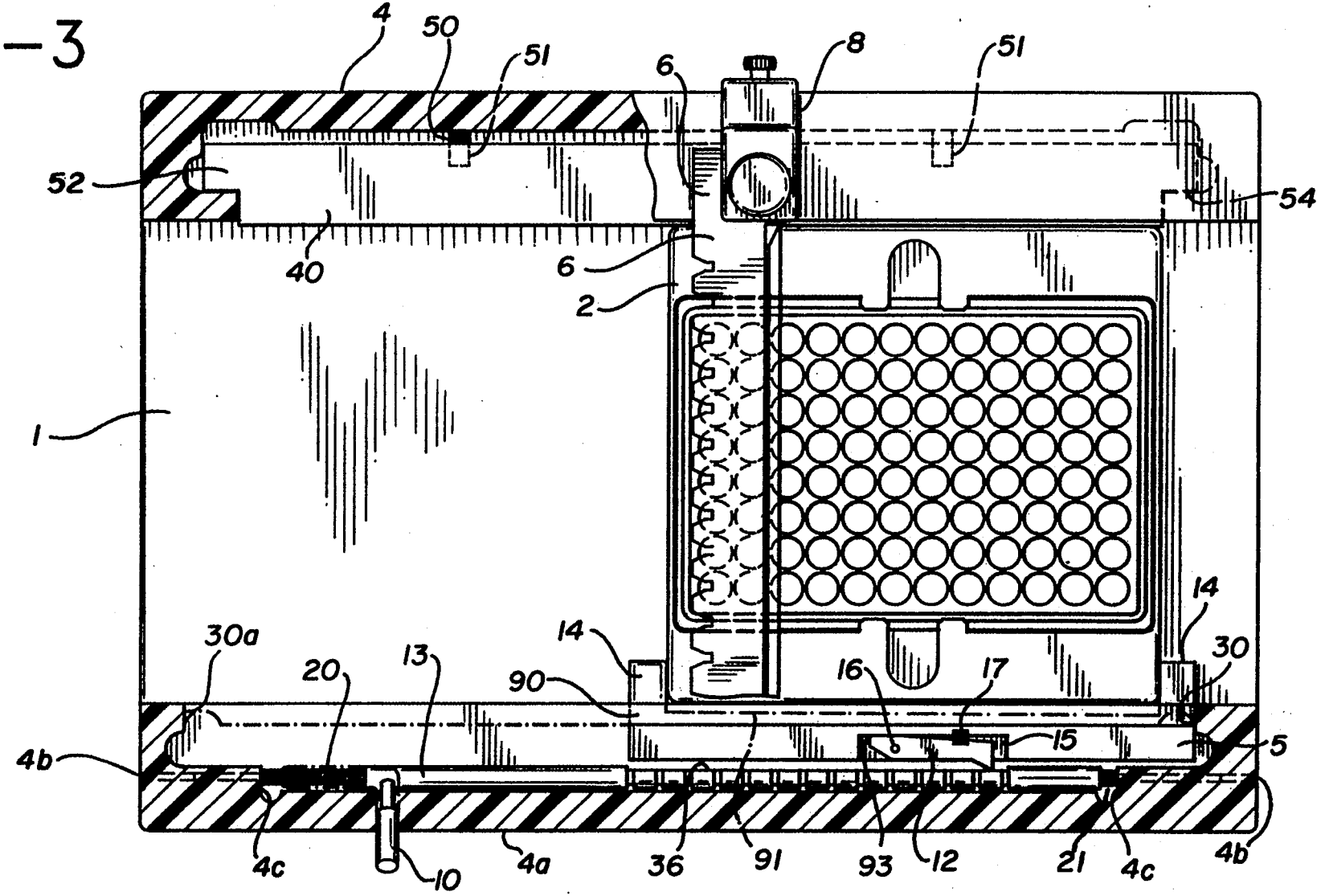
FIGS. 3, 3*a* and 3*b* illustrate a preferred ratchet and lever configuration for manually advancing the slide holder as well as an optional friction bar.
Figure 3A:
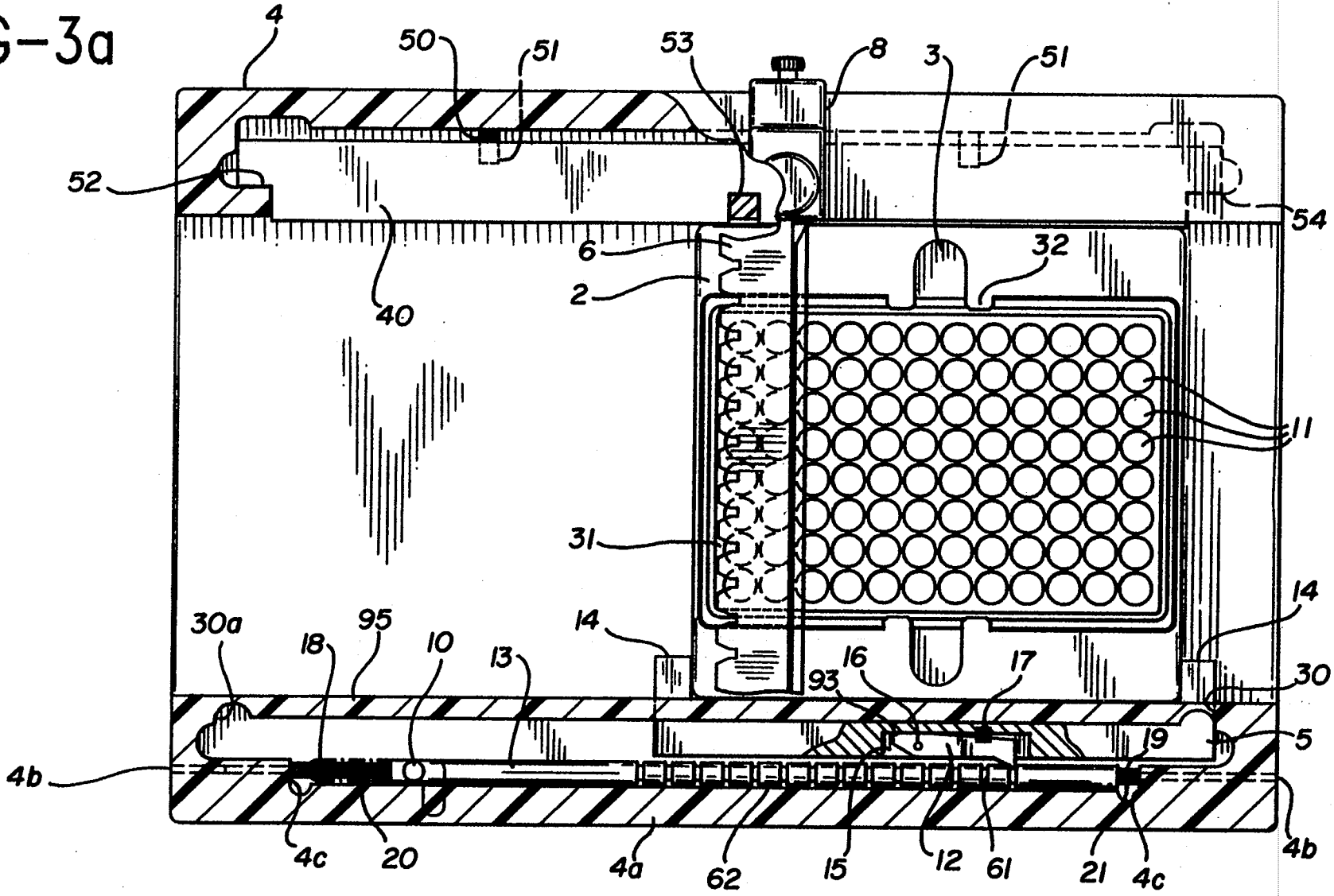
Figure 3B:
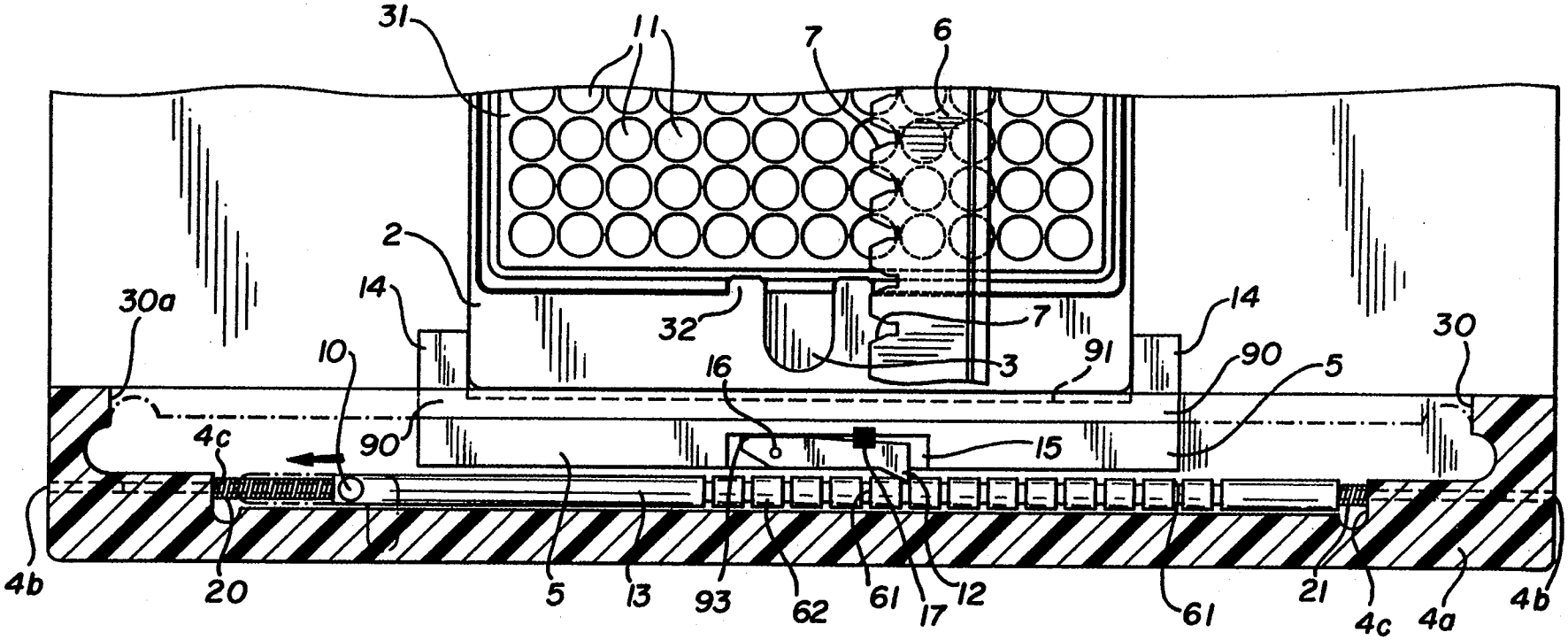

Ratchet clip 12 is inserted in a slot 15 in intermittent ratchet advance means 5 and secured therein with pin 16; ratchet clip 12 is mounted in slot 15 such that only the pawl projects past the slot as will be seen in FIGS. 3, 3a and 3b. Spring 17, which is inserted in slight counterbores in intermittent ratchet advance 5 and ratchet clip 12, exerts an outward pressure on the pawl of ratchet clip 12. Ratchet clip 12 is shaped such that the pawl end thereof projects from slot 15 and contacts rod 13 while the head end at 93 contacts the bottom of slot 15 and thus controls the distance of travel of the pawl of clip 12.

Notched incremental control rod 13 is provided with smaller diameter pins 18 and 19 at the ends thereof which smaller diameter pins fit in guide holes 4b at either end in underside rail 4a. Springs 20 and 21 fit over pins 18 and 19 and abut edges 4c provide opposing pressure against incremental control rod 13 in guide holes 4b to maintain position. Incremental control rod 13 is positioned between holder 5 and the two walls of rail 4a and base 1 in the recessed underside of rail 4a.

L-shaped slot 42 is provided in guide rail 4a to guide the movement of lever 10. Lever 10 is mounted through slot 42 and secured to incremental control rod 13 such as by being screwed into incremental control rod 13.

Slot 42 guides lever 10 as it is moved manually from the depressed position shown in FIG. 1 to the upright position as shown in FIG. 1*a*, and as lever 10 is moved to the left to advance holder 2.

In especially preferred practice, rail 4 also has a recessed underside in which is positioned friction bar 40 which exerts a slight pressure on holder 2 against rail 4*a*. With particular reference to FIGS. 3 and 3*a*, a plurality of springs 50 are mounted in apertures 51 in friction bar 40 and provide the necessary pressure; although only one such spring is illustrated, generally at least 2 springs placed at equal distances from the ends of friction bar 40 are used to provide uniform pressure. The friction bar 40 is restrained at notched points 52, 53 and 54 as shown, for example, in FIG. 3*a*, of rail 4 from extending an excessive distance past rail 4. Friction bar 40 extends only a very slight distance past rail 4 in order to provide a small uniform pressure on holder 2 against rail 4*a*.

Figure 4:
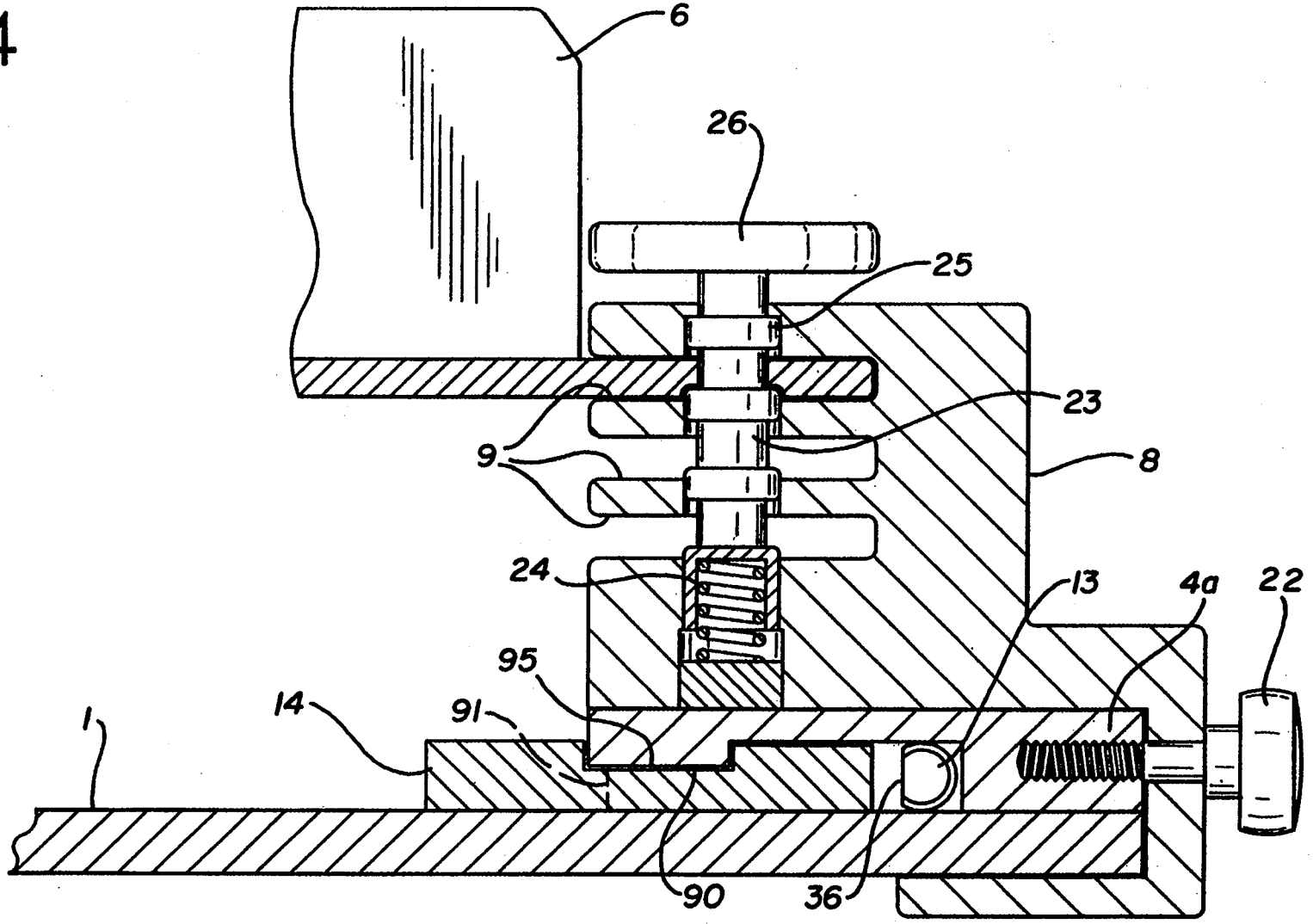
FIG. 4 illustrates the preferred bridge support.
Figure 5:
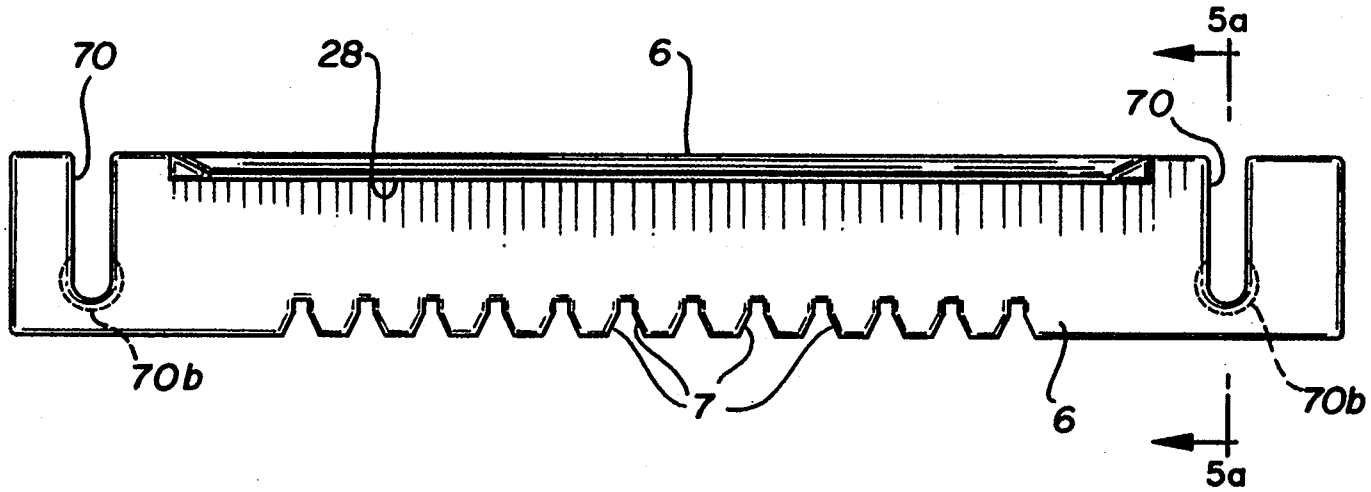
FIGS. 5 and 5*a* illustrate a suitable bridge configuration.
Figure 5A:
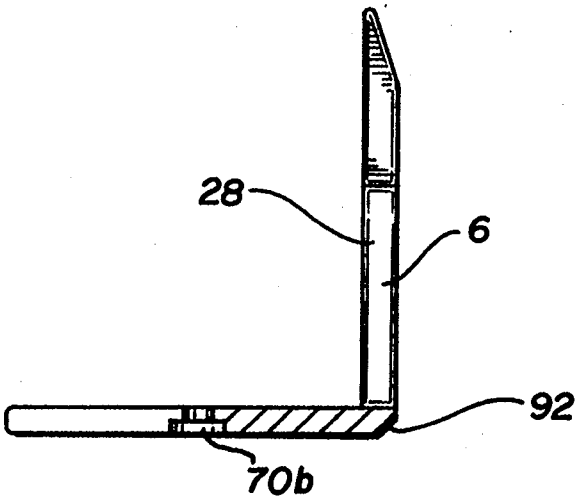
Figure 6:
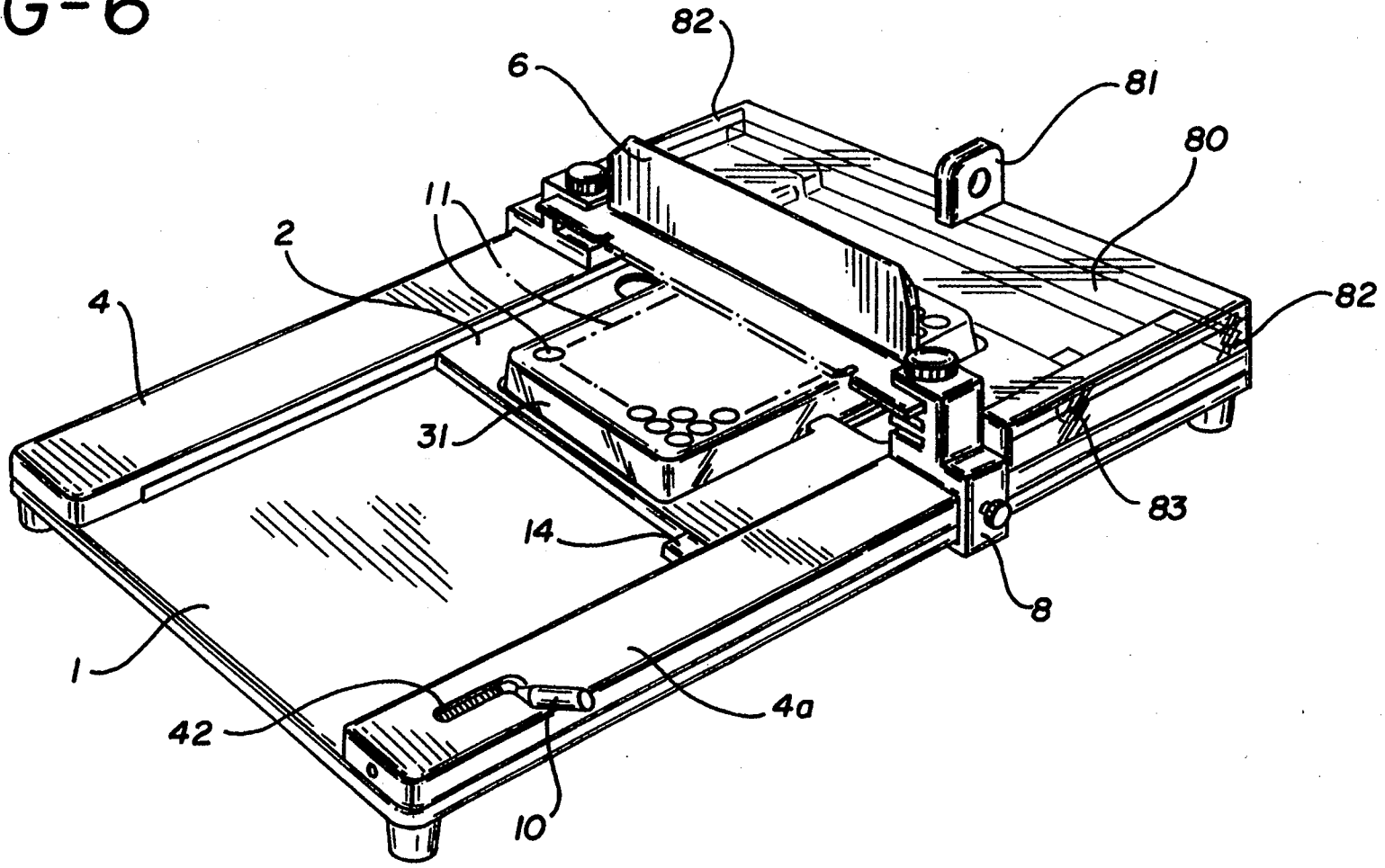
FIG. 6 illustrates the use of a partial cover with the apparatus of the invention.

With reference to FIGS. 2 and 4, holder 5 is U-shaped lengthwise and is provided with slots 90 which engage the lower rail 95 on underside of rail 4*a* on the side adjacent holder 2. It is important that slots 90 maintain holder 5, except for end projections 14, slightly recessed within rail 4*a* such that holder 2 contacts only projections 14 of holder 5 as well as rail 4*a*. Upon application of the slight pressure from friction bar 40, holder 2 contacts side rail 4*a* but not edge 91 of holder 5 which is recessed within rail 4*a*. See FIGS. 3 and 3*b*. The slight pressure of holder 2 on rail 4*a* provides the slight resistance to holder 5 via projections 14 to aid in accuracy of movement of holder 2 in operation of the incremental advance means.

Referring next to FIGS. 3, 3*a* and 3*b*, these Figures provide additional information with regard to operation of the lab-top work station of the present invention using the same numbering as in FIGS. 1, 1*a* and 2. Referring to FIG. 3, 3*a* and 3*b*, means 5 is shown sized to securely maintain holder 2 in place and advance same through action of lever 10 and incremental control rod 13. Incorporated in means 5 is ratchet clip 12 with spring 17 as previously described.

Incremental control rod 13 is mounted in the recessed hollow space at the underside of rail 4*a* between points 4*c* by insertion of pins 18 and 19 through springs 20 and 21 into guide holes 4*b*. Preferably, control rod 13 is made of a flexible one-piece plastic and is flexed for ease of insertion in guide holes 4*b*. Control rod 13 is sized longer than the distance between points 4*c* to permit the necessary advancing motion due to action of lever 10 while always remaining in guide holes 4*b*.

Notched incremental control rod 13 has a flat side 36 and is positioned such that when lever 10, which is screwed into rod 13, is depressed as indicated in FIG. 3, notched incremental control rod 13 is rotated to the position shown wherein the flat side 36 of incremental control rod 13 contacts the pawl of ratchet clip 12 permitting incremental ratchet advance holder 5, and consequently slide or plate holder 2, to be moved as indicated to the far right position where the end of holder 5 abut edge 30 of the recessed portion of rail 4*a* placing the plate or slide in appropriate starting position. A comparable edge 30*a* acts as a stop at the left side for holder 5.

As shown, for example, in FIGS. 3*a* and 3*b*, incremental control rod 13 has a plurality of segments 62 which are separated by recesses 61. Generally the length of segments 62 corresponds to the distance between well centers on the slide or plate 31 which is the distance it is desired to move holders 2 and 5 on each incremental advance.

When lever 10 is manually moved to the upright position in slot 42 as indicated in FIG. 3*a* and 3*b*, notched incremental control rod 13 is rotated to the position shown wherein the pawl of ratchet clip 12 engages recessed space 61 between segments 62 as shown.

FIG. 3*a* shows the starting position with the pawl of ratchet clip 12 engaged in the first recessed space 61 of control rod 13.

FIG. 3*b* shows position of the various components at an intermediate stage of the liquid application.

When lever 10 is moved to the left, notched incremental control rod 13, which is engaged to intermittent ratchet advance holder 5 by ratchet clip 12, moves the same distance and transfers holder 5 and plate or slide holder 2 this predetermined distance. By this mechanism, the holder 2, and consequently a slide or plate positioned therein, is moved the designated distance to the left bringing a fresh row of slide or plate wells 11 into position for application of liquid thereto. When lever 10 in the upright position is released by the operator, it returns to the position shown in FIG. 3*b* until it is again manually moved by the operator after application of liquid to the appropriate wells 11 on slide or plate 31, and this procedure is repeated until liquid has been applied to as many wells as desired.

When liquid application to a particular slide or plate 31 has been completed, the slide or plate 31 is lifted from holder 2, a fresh slide or plate 31 can be inserted, and by depression of lever 10, notched incremental control rod 13 is rotated so that the flat side 36 again engages the pawl of ratchet clip 12 and the plate or slide holding device 5 can be moved and reset at the far right starting position as shown in FIG. 3.

Generally speaking, base 1 is made of a hard plastic, although metal can be employed where desired. Likewise, most of the other components preferably are made of plastic, although frequently bridge 6, support means 8, holder 2 and/or holder 5 are conveniently made of metal such as aluminum or stainless steel as is ratchet clip 12. However, the material of construction for the various components can be varied depending on the cost and preferably the availability of various non-corrosive and autoclavable materials and the ease of forming and assembling the various components as well as the specific use extended for the work station.

The apparatus set forth herein is broadly applicable, especially in the field of biological testing.

Included among the outstanding advantages which are achieved by the present invention is the fact that use of the lab-top work station of this invention substantially improves the ease and accuracy of liquid application, improves the ease and accuracy of indexing, and significantly reduces cross-contamination between rows of microwells on a particular slide or plate. Use of the work station of this invention allows the operator to easily keep track of the position on a plate or slide to which liquid is to be applied and aids the operator in determining with ease and precision the slide or plate rows to which liquid has been applied and the rows remaining for liquid application.

It should be noted that the work station depicted in the drawings is designed for a right-handed operator wherein liquid is dispensed with the right hand and lever 10 operated with the left hand. The work station can be made for operation by a left-handed person by reversing the bridge and incremental advance means.

I claim:

1. Incremental manual advance means comprised of a control rod having both a surface with notches spaced a predetermined distance apart and an unnotched surface, manual lever means secured to the control rod to rotate the control rod and to advance the control rod the incremental distance corresponding to the distance between said notches, ratchet means engaging with the notched surface of the control rod and to advance said predetermined distance with the control rod, holder means secured to said ratchet means to move with the ratchet means, said ratchet means contacting the unnotched surface of the control rod upon manual rotation of the control rod and to slide along the unnotched surface of the control rod without motion of the control rod, and spring means returning the control rod to the original position after each incremental advance.

* * * * *